US005175986A

United States Patent [19]

Farley

[11] Patent Number: 5,175,986

[45] Date of Patent: Jan. 5, 1993

[54] ORTHOPAEDIC SADDLE PAD

[76] Inventor: Michael D. Farley, 2294 N. Riverside Dr., Indialantic, Fla. 32903

[21] Appl. No.: 745,699

[22] Filed: Aug. 16, 1991

[51] Int. Cl.[5] ..... B68C 1/12

[52] U.S. Cl. ..... 54/44.1; 54/66

[58] Field of Search ..... 54/44, 65, 66

[56] References Cited

U.S. PATENT DOCUMENTS

| | | | |
|---|---|---|---|
| 2,072,188 | 3/1937 | Tauber | 54/66 |
| 3,371,467 | 3/1968 | Salisbury, III | 54/44 |
| 4,683,709 | 8/1987 | Vasko et al. | 54/66 |
| 4,974,397 | 12/1990 | Ricken | 54/66 |

FOREIGN PATENT DOCUMENTS

| | | | |
|---|---|---|---|
| 26206 | of 1907 | United Kingdom | 54/66 |

*Primary Examiner*—Robert P. Swiatek

*Attorney, Agent, or Firm*—Dickinson, Wright, Moon, Van Dusen & Freeman

[57] ABSTRACT

A pad for a saddle includes a number of layers of compressible material. Uppon layers fill the space between the saddle and the spine of the animal formed by the gullet of the saddle. Lower layers of the compressible material are contiguous with the upper layers and evenly distribute the load of the saddle over the back of the animal.

15 Claims, 1 Drawing Sheet

FIG. 1
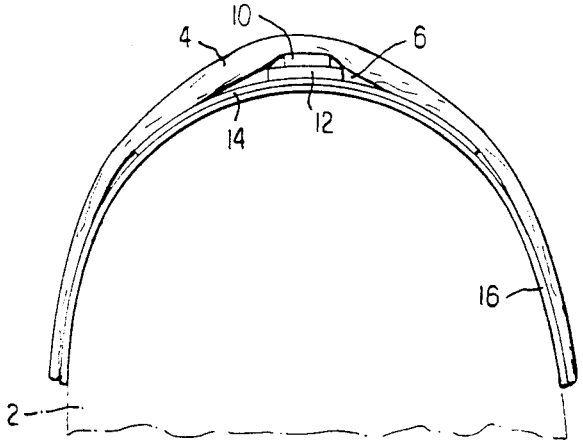
FIG. 2
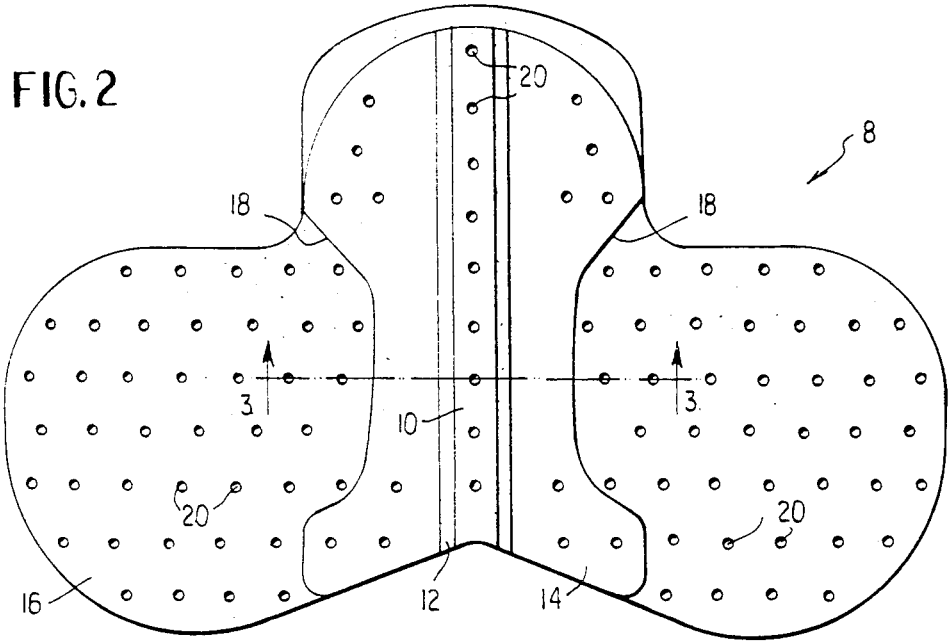
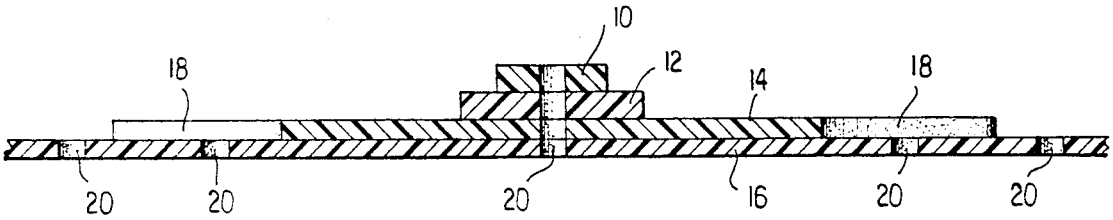
FIG. 3

ORTHOPAEDIC SADDLE PAD

TECHNICAL FIELD

This invention relates to a pad for use with a saddle.

BACKGROUND

A saddle on which a rider sits is designed to prevent application of the weight of the rider to the spine of an animal. A typical saddle for a horse has a longitudinal void, or "gullet", extending the length of the saddle for providing a space between the saddle and the spine of the horse. This space prevents contact between the spine and the saddle because the spine can be bruised by application of the weight of the rider to it.

A problem arises, however, with the traditional saddle because the weight of the rider is not evenly distributed to the back of the animal. Those areas of the animal which receive greater force are often injured, particularly if the rider is heavy or the riding session is long or difficult. The general practice is to place a blanket between the saddle and the animal in an attempt to distribute the weight and prevent injury, but this is usually not successful.

SUMMARY OF THE INVENTION

In accordance with the invention, a unique pad distributes the weight of the rider and saddle over the back of an animal and protects the spine from injury. A first portion of the pad engages the top of the saddle gullet and spreads the forces from this part of the saddle. A second part of the pad engages the first portion and other parts of the saddle and further spreads the forces to evenly distribute the load of the rider and saddle over the back of the animal.

In a preferred embodiment, the pad is made of a plurality of layers of resilient material such as polyurethane. The first portion of the pad, which fills the gullet, comprises two layers bonded to each other, the lower one being wider than the upper one. The second portion of the pad also includes two layers bonded to each other, and the lower layer of the first part is bonded to an upper layer of the second part. The lower layer of the second part essentially conforms to the shape of the saddle.

The layers are of different densities. The two layers of the first portion of the pad are preferably "6E" polyurethane, the upper layer of the second portion is also "6E" polyurethane, and the lower layer of the second portion is "4E" polyurethane. By this construction, the forces applied to the gullet of the saddle are spread out laterally to layers of the pad which are increasingly wider. Thus, the weight is evenly distributed over the back of the animal.

BRIEF DESCRIPTION OF THE DRAWINGS

FIG. 1 is a schematic front view of an animal and saddle using the pad of the invention.

FIG. 2 is a top view of a pad according to the invention.

FIG. 3 is a cross section taken along line 3—3 of FIG. 2.

DETAILED DESCRIPTION OF THE PREFERRED EMBODIMENT

With reference to FIG. 1, the back 2 of an animal is shown schematically in a phantom line, and a saddle 4 is also shown schematically. The saddle may take any of several forms known in the art, but is of the type having a gullet which forms a void 6 between the spine of the animal and the ridge of the saddle.

Referring to the figures generally, a pad 8 according to the invention comprises a series of layers of resilient polyurethane foam material for distributing the weight of the rider and saddle over the back of the animal. The pad includes a first portion comprising upper layer 10 and a lower layer 12. The upper layer 10 is narrower than the lower layer 12 whereby the first portion is tapered for filling the void created by the gullet of the saddle. The upper surface of the layer 10 engages the top of the gullet and the outer surfaces of the layers 10 and 12 deform so as to engage substantially the entire inner surface of the gullet.

The bottom surface of the layer 12 contacts the upper surface of the second portion, which is in turn formed by two layers 14 and 16. Layer 16 extends over the area where the saddle has contact with the animal and is the largest of the layers. Side parts of the layer 16 engage those parts of the saddle which are not considered to be weight bearing. For example, a saddle typically includes leather flaps engaged by the knees of the rider but which do not carry the weight of the rider. Layer 16 is of a material having a lesser density to allow the rider to feel the horse with the knees to permit accurate control of the animal.

Layer 14 is contoured at 18 so that the layer conforms to the shape of the weight bearing portion of the saddle. Thus, the layers 10, 12, and 14 carry the majority of the weight of the rider and saddle, and these are made of materials of density heavier than that of layer 16. Layers 10, 12, and 14 are preferably of "6E" polyurethane, while layer 16 is of "4E" polyurethane. In a preferred embodiment, layer 10 has a thickness of about $\frac{3}{8}$ in. and a width of about $1\frac{1}{2}$ in., layer 12 has a thickness of about $\frac{3}{8}$ in. and a width of about $2\frac{3}{8}$ in., and layer 14 has a thickness of about $\frac{3}{8}$ in. and is about 13 in. across at it widest part. Layer 16 has a thickness of about $\frac{1}{4}$ in.

The designations "6E" and "4E" apply to materials having a variety of properties, but one important property is the extent to which the material can be said to distribute the force applied to one surface. The "6E" material in general distributes a load applied to one surface to a larger area on the opposite surface than does the "4E" material.

In the preferred embodiment, each of the layers is bonded to its contiguous layer or layers to provide a unitary pad which can be easily placed on an animal and to transfer loads through a more positive contact. It is possible, however, for the layers to be separate elements.

The pad shown in the drawings is stepped due to the use of discrete layers. The pad could be molded such that the profile is smooth, and the first portion comprising layers 10 and 12 could be a solid molded portion having substantially the exact profile of the saddle's gullet.

The pad is provided with a number of holes 20 for allowing air to circulate through the pad to allow the animal to cool through vaporation of the perspiration. These holes could be eliminated if a resilient material having high permeability to air and vapor were used.

I claim:

1. In combination, a saddle for engaging the back of an animal and a saddle pad for being placed between said saddle and said back of an animal, wherein said saddle pad comprises weight distributing means for distributing the weight of the saddle and a rider thereon evenly over the back of an animal, wherein said saddle includes a gullet extending over the spine of said animal forming a void between said saddle and said spine, and said weight distributing means comprises resilient material substantially filling said void.

2. A combination according to claim 1 wherein said resilient material comprises a plurality of resilient layers of having different resiliencies.

3. A combination according to claim 1 wherein said resilient material comprises at least two resilient layers, a lower layer extending laterally beyond an upper layer.

4. A combination according to claim 1 wherein said resilient material comprises an upper layer which narrows toward the top and a lower layer which extends laterally substantially beyond said void.

5. A combination according to claim 4 wherein said upper layer comprises two layers bonded together.

6. A combination according to claim 4 wherein said lower layer comprises two layers having different resilient characteristics, an upper of said two layers having a lateral extent less than that of a lower of said two layers.

7. A combination according to claim 6 wherein the density of said upper layer is greater than that of said lower layer.

8. A saddle pad comprising:

a lower layer of resilient material for being placed over the back of an animal and absorbing forces on said pad created by the weight of a rider and an upper layer of resilient material for filling substantially a void formed by the gullet of a saddle between the spine of said animal and the top of said saddle, absorbing forces created by the weight of a rider, and transferring said forces to said lower layer.

9. A saddle pad according to claim 8 wherein said resilient material is polyurethane.

10. A saddle pad according to claim 8 wherein said lower layer extends laterally substantially beyond said upper layer.

11. A saddle pad according to claim 10 wherein the density of said upper layer is greater than that of said lower layer.

12. A method for distributing the weight of a saddle and a rider over the back of an animal comprising placing between said saddle and said back of an animal a saddle pad comprising a lower layer of resilient material for absorbing forces on said pad created by the weight of said saddle and rider and an upper layer of resilient material for filling substantially a void formed by the gullet of said saddle between the spine of said animal and the top of said saddle and transferring said forces to said lower layer.

13. In combination, a saddle for engaging the back of an animal and a saddle pad for being placed between said saddle and said back of an animal, wherein said saddle pad comprises weight distributing means for distributing evenly over said back of an animal the weight of the saddle and a rider thereon, wherein said saddle includes a gullet extending over the spine of said animal forming a void between said saddle and said spine, said weight distributing means comprises resilient material in said void extending between said saddle and said spine, said resilient material comprises an upper layer which narrows toward the top and a lower layer which extends laterally substantially beyond said void, and said upper layer comprises two layers bonded together.

14. In combination, a saddle for engaging the back of an animal and a saddle pad for being placed between said saddle and said back of an animal, wherein said saddle pad comprises weight distributing means for distributing evenly over the back of an animal the weight of the saddle and a rider thereon, wherein said saddle includes a gullet extending over the spine of said animal forming a void between said saddle and said spine, said weight distributing means comprises resilient material in said void extending between said saddle and said spine, said resilient material comprises an upper layer which narrows toward the top and a lower layer which extends laterally substantially beyond said void, and said lower layer comprises two layers having different resilient characteristics, an upper of said two layers having a lateral extent less than that of a lower of said two layers.

15. A combination according to claim 14 wherein the density of said upper layer is greater than that of said lower layer.

* * * * *